US008118543B2

(12) United States Patent
Umeyama et al.

(10) Patent No.: US 8,118,543 B2
(45) Date of Patent: Feb. 21, 2012

(54) CENTRIFUGAL COMPRESSOR HAVING SWITCHABLE TWO PASSAGES

(75) Inventors: Ryo Umeyama, Kariya (JP); Toshiro Fujii, Kariya (JP); Kazuho Yamada, Kariya (JP); Manabu Ishikawa, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 1087 days.

(21) Appl. No.: 11/948,266

(22) Filed: Nov. 30, 2007

(65) Prior Publication Data

US 2008/0138200 A1 Jun. 12, 2008

(30) Foreign Application Priority Data

Dec. 7, 2006 (JP) ..... P2006-330080

(51) Int. Cl.
*F04D 27/00* (2006.01)
*F01D 17/14* (2006.01)
*F01D 17/00* (2006.01)

(52) U.S. Cl. ..... 415/150; 415/204; 415/206; 415/207; 415/224.5

(58) Field of Classification Search ..... 415/26, 415/27, 203, 204, 207, 212.1, 224.5, 150
See application file for complete search history.

(56) References Cited

U.S. PATENT DOCUMENTS 3,071,347 A * 1/1963 Schinnerer ..... 415/156
3,829,235 A * 8/1974 Woollenweber, Jr. ..... 415/143
4,219,305 A * 8/1980 Mount et al. ..... 415/13
4,378,194 A 3/1983 Bandukwalla
4,460,310 A * 7/1984 Plunkett ..... 415/26
6,905,535 B2 * 6/2005 Keefer et al. ..... 96/125

FOREIGN PATENT DOCUMENTS

CN 1461893 A 12/2003
JP 11-30199 A 2/1999
JP 2004-197612 A 7/2004
JP 2005-194933 A 7/2005
JP 2005240713 A * 9/2005

OTHER PUBLICATIONS

English Summary of CN Office Action dated dated Jan. 23, 2009 for corresponding CN Application No. 02120754.2.
English Summary of CN Office Action dated Jul. 17, 2009 for corresponding CN Application No. 200710306874.X.

* cited by examiner

*Primary Examiner* — Edward Look
*Assistant Examiner* — Jesse Prager
(74) *Attorney, Agent, or Firm* — Knoble Yoshida & Dunleavy, LLC

(57) ABSTRACT

A centrifugal compressor for compressing gas has a casing, a rotary shaft, an impeller, a diffuser, a first scroll, a second scroll, a first passage, a second passage, and a switching member. The rotary shaft is supported by the casing. The impeller is rotatably fixed to the rotary shaft, and sends the gas radially outward to a flow path downstream thereof. The diffuser is formed around the impeller. The first scroll is formed around the diffuser. The second scroll is formed between the diffuser and the impeller. The first passage is formed from the impeller to the first scroll through the diffuser. The second passage is formed from the impeller to the second scroll. The switching member switches the flow path between the first passage and the second passage by opening and closing the diffuser.

8 Claims, 9 Drawing Sheets

CENTRIFUGAL COMPRESSOR HAVING SWITCHABLE TWO PASSAGES

BACKGROUND OF THE INVENTION

The present invention relates to a centrifugal compressor having an impeller.

A centrifugal compressor is known as one of compressors for compressing gas. Japanese unexamined patent publication No. 2005-194933 discloses a centrifugal compressor which has a fluid passage for communicating with a diffuser, a pair of scrolls for receiving gas from the diffuser and discharging out of the compressor, and a changing means for changing the width of the passage in the diffuser. The changing means changes the width of the passage so that the passage is changed into a narrow passage state where the diffuser is in communication with only one of the scrolls, or into a wide passage state where the diffuser is in communication with both of the scrolls.

The above-described centrifugal compressor has a first operational mode and a second operational mode, which are set selectively. The first operational mode is set so that the width of the passage in the diffuser is widened to utilize two scrolls. The second operational mode is set so that the width of the passage in the diffuser is narrowed to utilize one scroll. That is, in the centrifugal compressor, the first operational mode and the second operational mode are set alternatively by switching the state between the narrow passage state and the wide passage state. Accordingly, the centrifugal compressor can achieve high compression efficiency in a substantially wide range of the flow rate with its simple structure.

The above-described compressor can set the width of the passage in the diffuser variably by the changing means for changing the width of the passage. However, diffuser stall still exists continuously. When the flow rate in the centrifugal compressor is extremely low, specifically, diffuser stall occurs inevitably in the compressor. Diffuser stall invites problems such as vibration of the compressor, and thereby prevents the stable operation of the compressor.

The present invention is directed to providing a centrifugal compressor in which diffuser stall is prevented when the flow rate of the gas is low, so as to obtain stable operation in a wide range of the flow rate.

SUMMARY OF THE INVENTION

In accordance with the present invention, a centrifugal compressor for compressing gas has a casing; a rotary shaft supported by the casing; an impeller rotatably fixed to the rotary shaft, wherein the impeller sends the gas radially outward to a flow path downstream thereof; a diffuser formed around the impeller and defined by a pair of diffuser walls having the diffuser therebetween; a first scroll formed around the diffuser; a second scroll formed between the diffuser and the impeller; a first passage formed from the impeller to the first scroll through the diffuser; a second passage formed from the impeller to the second scroll; and a switching member for switching the flow path between the first passage and the second passage by opening and closing the diffuser, wherein the switching member includes a movable diffuser wall which is at least one of the pair of the diffuser walls, wherein the movable diffuser wall is moved closer to and away from the other of the pair of the diffuser walls so as to switch the flow path between the first passage and the second passage, wherein a wall surface of the movable diffuser wall facing the diffuser includes a diffuser wall surface and a scroll wall forming surface, wherein the scroll wall forming surface forms part of an inner surface of the second scroll.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
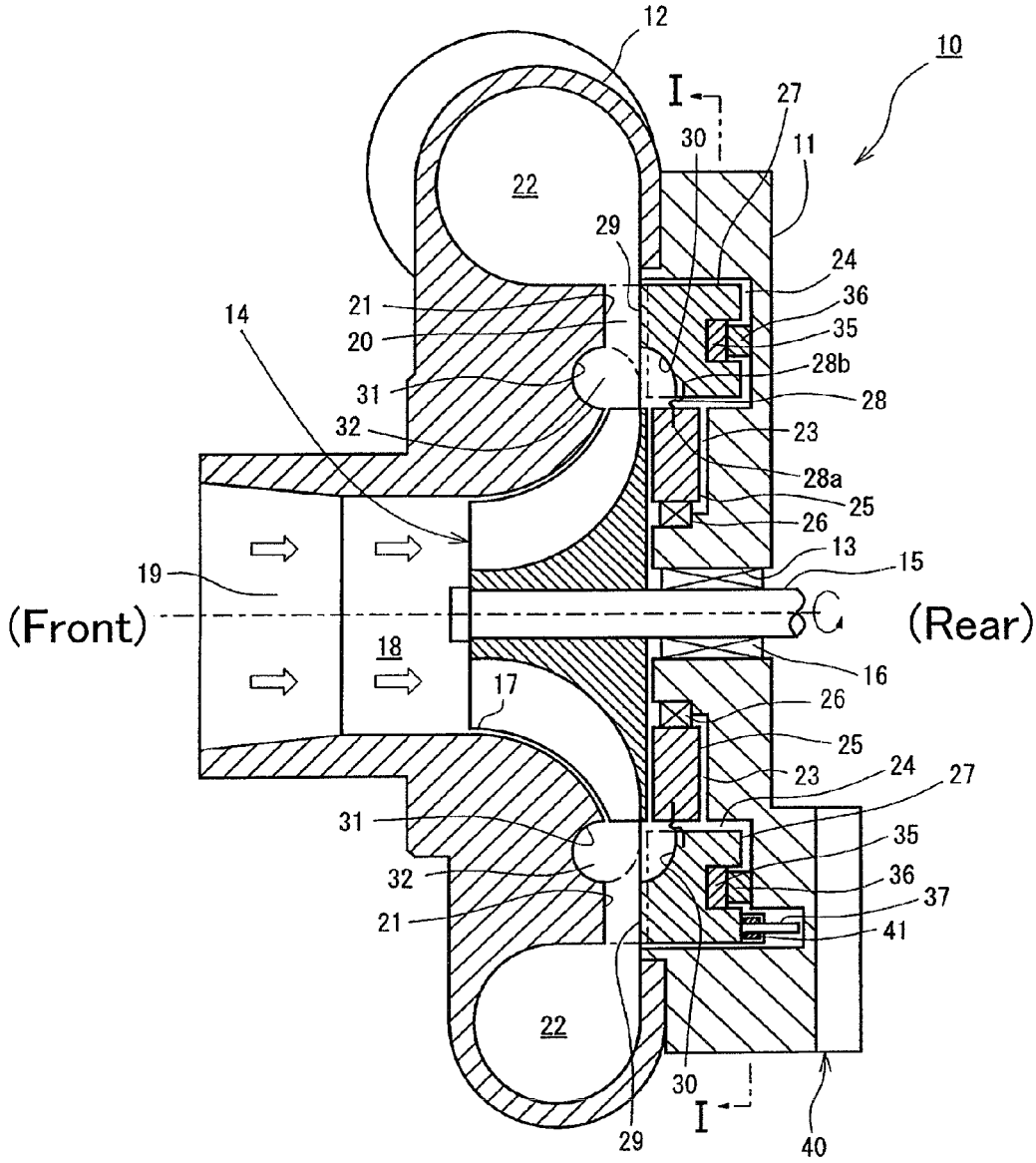
FIG. 1 is a side cross-sectional view of a centrifugal compressor according to a first preferred embodiment of the present invention.

The following will describe a first preferred embodiment of a centrifugal compressor according to the present invention with reference to FIGS. 1 through 6. The centrifugal compressor 10 according to the first preferred embodiment has a first casing 11, a second casing 12, an impeller 14, a diffuser 20, a first scroll 22, and a second scroll 32, as shown in FIG. 1. The first casing 11 and the second casing 12 are coupled to each other to form a casing assembly. The impeller 14 is rotatably received in the first and the second casings 11, 12 so as to send the gas radially outward to a flow path downstream thereof. The diffuser 20 is formed around the circumference of the impeller 14. The first scroll 22 is formed around the circumference of the diffuser 20. The second scroll 32 is formed between the impeller 14 and the diffuser 20. The centrifugal compressor 10 includes a first passage, a second passage, and a switching member. The first passage is formed from the impeller 14 to the first scroll 22 through the diffuser 20. The second passage is formed from the impeller 14 to the second scroll 32. The switching member selectively switches the flow path downstream of the impeller 14 between the first passage and the second passage by opening and closing the diffuser 20.

A space 17 which has a funnel shape is defined In the casing assembly formed by the first casing 11 and the second casing 12. The impeller 14 is disposed in the space 17 and fixed to a rotary shaft 15. The rotary shaft 15 extends through a shaft hole 13 in the first casing 11. The rotary shaft 15 is rotatably supported by the first casing 11 through a bearing 16 which has a sealing function. The left-hand side of the centrifugal compressor 10 corresponds to the front side and the right-hand side corresponds to the rear side as viewed in FIG. 1. The rear end of the rotary shaft 15 is connected to a drive source, such as a motor or the like (not shown), to be rotated therewith. The second casing 12 has a passage 18 with a constant diameter adjacent to the front side of the space 17. A suction port 19 is formed adjacent to the front side of the passage 18 to increase the diameter thereof so as to be flared out frontward.

The impeller 14 has a plurality of blades formed radially. The impeller 14 draws gas from the suction port 19 through the passage 18 in the axial direction, and sends the gas radially outward to the flow path downstream of the impeller 14. In the first embodiment, the first passage is formed to guide the gas from the impeller 14 to the first scroll 22 through the diffuser 20. The first passage is utilized when the flow rate of the centrifugal compressor 10 exceeds a predetermined level. When the first passage is formed, the impeller 14 sends the gas radially outward to the diffuser 20.

The diffuser 20 functions as a gas passage so as to decrease the velocity of the gas flowing out from the impeller 14 while increasing the pressure, and to send the gas to the first scroll 22. In other words, the diffuser 20 converts the velocity energy (kinetic energy) of the gas from the impeller 14 into the pressure energy. The diffuser 20 according to the first embodiment is defined by a pair of diffuser walls, which are formed in the first casing 11 and the second casing 12, respectively. The first casing 11 includes a movable diffuser wall 27, which will be described later. The second casing 12 includes a fixed diffuser wall 21.

The fixed diffuser wall 21 is formed by a planar surface perpendicular to the axis of the rotary shaft 15. The fixed diffuser wall 21 faces the movable diffuser wall 27 in the first casing 11. The first scroll 22 is formed in the second casing 12 so as to surround the fixed diffuser wall 21. The first scroll 22 is in communication with the diffuser 20, and also is in communication with an outlet port (not shown). A curved wall 31 is formed between the fixed diffuser wall 21 and the impeller 14 in the second casing 12 so as to form a concave in the surface adjacent to the fixed diffuser wall 21. The cross section of the curved wall 31 is formed with a hemispherical shape. The curved wall 31 constitutes a part of the second scroll 32.

In the rear side of the impeller 14 (in the right side in FIG. 1), an annular inner space 23 is defined in the front surface of the first casing 11 and an annular outer space 24 is defined around the inner space 23. An annular rotation support plate 25 is disposed in the inner space 23. The rotation support plate 25 is rotatably supported by the first casing 11 through a bearing 26 which has a sealing function. The length of the outer space 24 in the axial direction of the rotary shaft 15 is set larger than that of the inner space 23. The annular movable diffuser wall 27 is disposed in the outer space 24 so as to face the fixed diffuser wall 21, with the diffuser 20 therebetween.

In the first embodiment, the switching member for switching the flow path between the first passage and the second passage includes the movable diffuser wall 27, which is moved closer to and away from the fixed diffuser wall 21. The movable diffuser wall 27 is supported by the rotation support plate 25 through an annular flexible member 28 at the inner circumferential surface of the movable diffuser wall 27. The flexible member 28 is formed by a diaphragm. With the annular flexible member 28 in the form of the diaphragm, the movable diffuser wall 27 is protruded frontward in the direction to the diffuser 20 at the low flow rate, and is caved rearward in the direction to the outer space 24 at the high flow rate.

Figure 3:
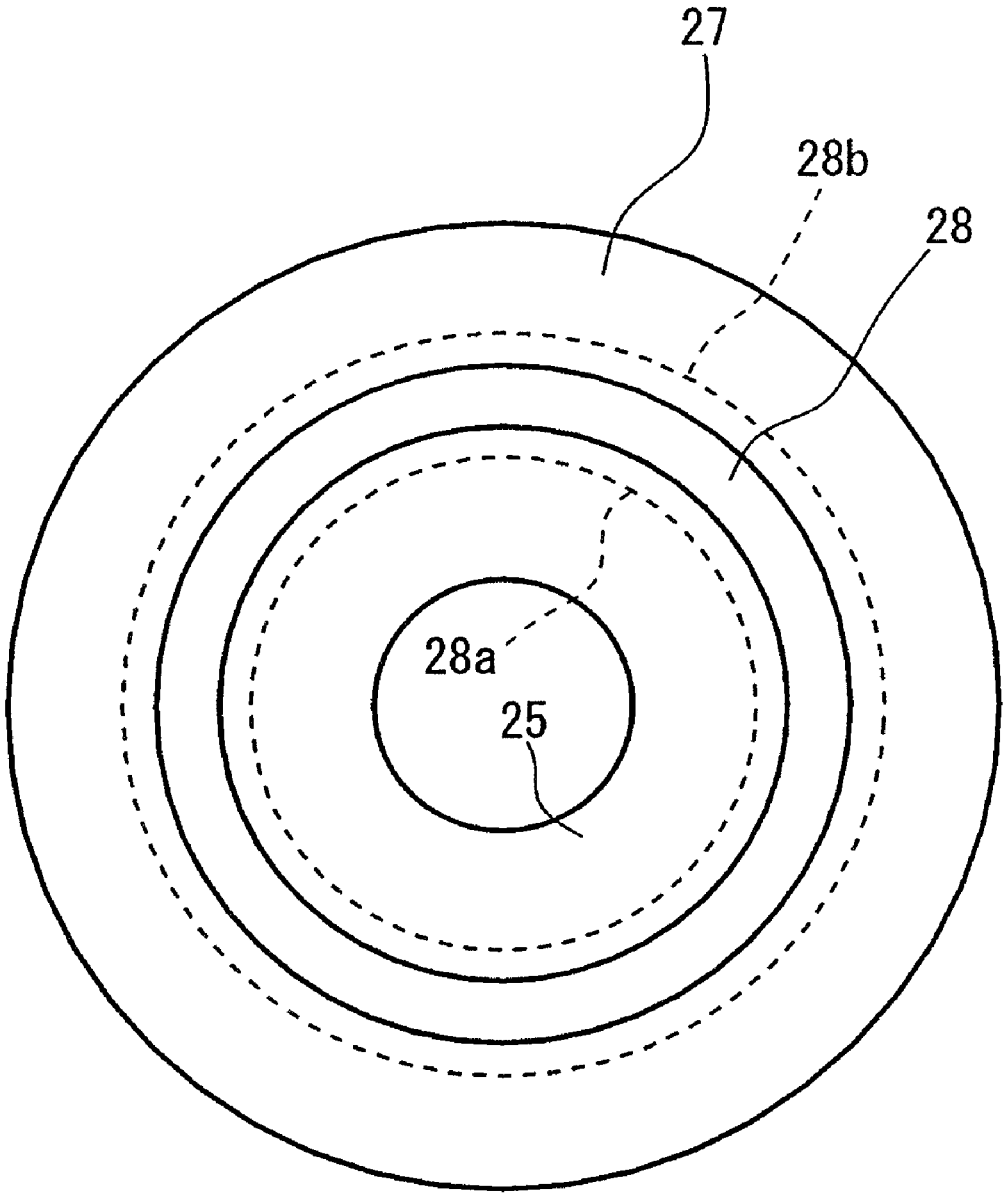
FIG. 3 is an enlarged fragmentary cross-sectional view illustrating the relation between a first casing and a movable diffuser wall.

The flexible member 28 is formed with an annular shape and a hole is formed at the center thereof, as shown in FIG. 3. The flexible member 28 is made of a material which has predetermined rigidity in the radial direction, and has deformable flexibility in the direction perpendicular to the radial direction (axial direction of the rotary shaft 15). An inner periphery 28*a* of the flexible member 28 is retained in an annular groove formed in the rotation support plate 25, and an outer periphery 28*b* of the flexible member 28 is retained in an annular groove formed in the movable diffuser wall 27. Thus, the rotation support plate 25, the flexible member 28 and the movable diffuser wall 27 are formed integrated. Accordingly, the movable diffuser wall 27 is rotatable in the circumferential direction together with the rotation support plate 25 and the flexible member 28, and is movable in the axial direction of the rotary shaft 15 by the flexible member 28.

Figure 2:
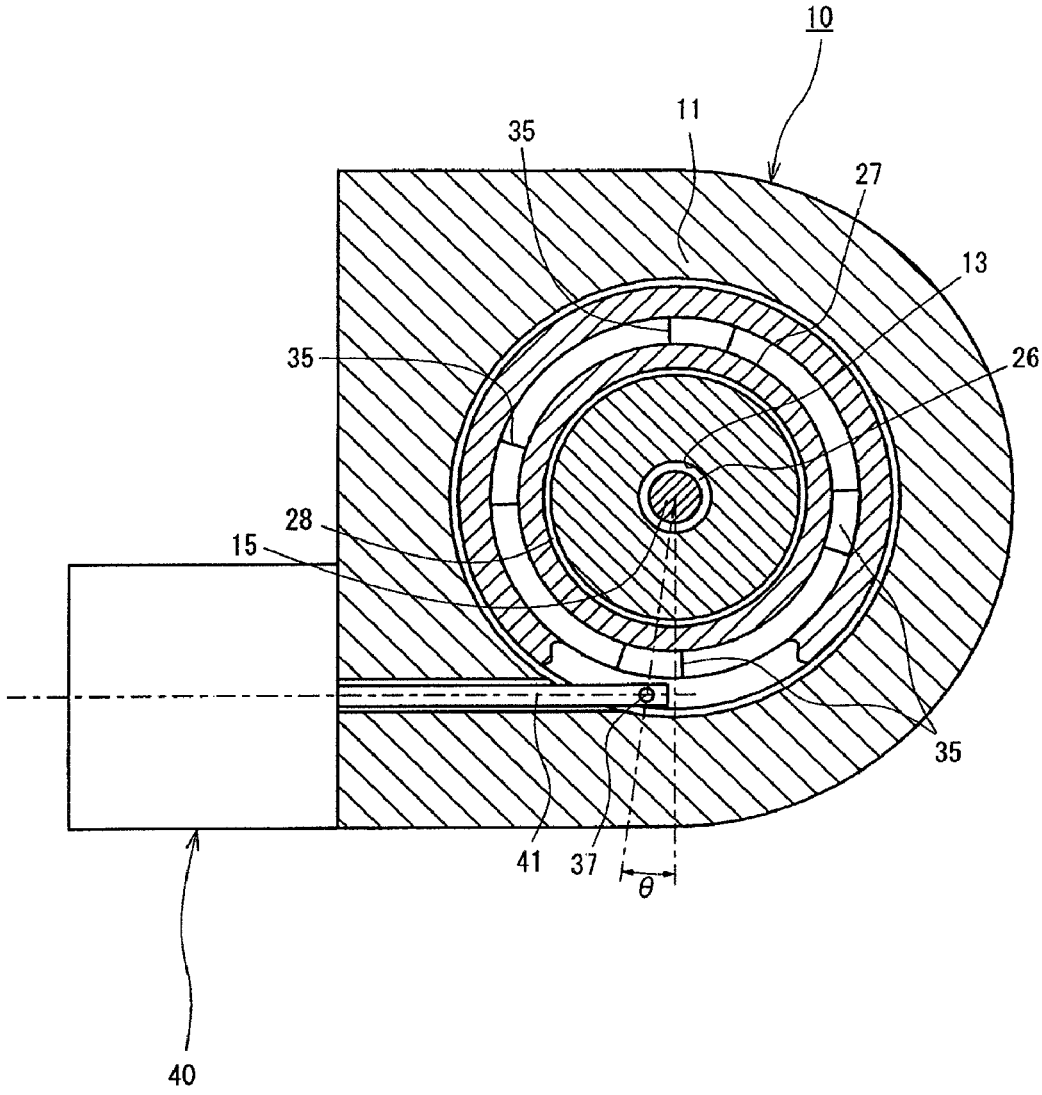
FIG. 2 is a cross-sectional view that is taken along the line I-I in FIG. 1.

As shown in FIG. 2, a movable cam 35 is fixed to the movable diffuser wall 27 on the rear side to be disposed in the outer space 24. The movable cam 35 includes four inclined portions which have inclined movable cam surfaces on the rear side thereof, respectively. The movable cam 35 is formed with an arc shape coaxially with the movable diffuser wall 27, and the inclined portions are positioned circumferentially to be separated with each other. The movable cam surfaces of the movable cam 35 are formed with inclined surfaces whose height are gradually decreased in the clockwise direction in FIG. 2 (upward direction in FIG. 6). A fixed cam 36 is formed in the front surface of the first casing 11 to be disposed in the outer space 24. The fixed cam 36 is formed with an arc shape, and includes four inclined portions which have fixed cam surfaces on the front side thereof, respectively. The position of the four fixed cam surfaces correspond to the movable cam surfaces of the movable cam 35. The cam surfaces of the fixed cam 36 are formed with inclined surfaces whose height are gradually decreased in the counter-clockwise direction so as to be formed reversely to the movable cam 35. The movable cam 35 and the fixed cam 36 are positioned so that the movable cam surfaces and the fixed cam surfaces are continuously in contact with each other. According to the first embodiment, the movable cam 35 is urged to the fixed cam 36 by the gas pressure in the diffuser 20, but may be continuously in contact with each other by a spring and the like.

A connecting pin 37 is connected to the back surface (rear surface) of the movable diffuser wall 27 and is projected therefrom. The connecting pin 37 is longer than the moving distance of the movable diffuser wall 27 in the axial direction of the rotary shaft 15. An actuator 40 is attached to the first casing 11. The actuator 40 has a rod 41, which is rotatably connected to the connecting pin 37. The rod 41 is slidable in the longitudinal direction of the connecting pin 37. Accordingly, when the actuator 40 is actuated and the rod 41 is moved in its longitudinal direction, the movable diffuser wall 27 is rotated by a predetermined degree. The actuator 40 is a driving source to move the rod 41 forward and backward, and is actuated in accordance with the flow rate of the centrifugal compressor 10. According to the first embodiment, the actuator 40 is actuated when the flow rate is determined to exceed a predetermined level. The actuator 40 may be preferably a fluid pressure cylinder or an electric motor, or the like.

The front surface of the movable diffuser wall 27 (a wall surface facing the diffuser 20) has a diffuser wall surface 29 and a scroll wall forming surface 30. The diffuser wall surface 29 is formed with a surface perpendicular to the axial direction of the rotary shaft 15. The scroll wall forming surface 30 is formed correspondingly to a curved wall 31 so that the scroll wall forming surface 30 and the curved wall 31 form the inner surface of the second scroll 32. The diffuser wall surface 29 faces the fixed diffuser wall 21, and is moved closer to and away from the fixed diffuser wall 21 in accordance with the displacement of the movable diffuser wall 27. When the diffuser wall surface 29 is moved to the closest to the fixed diffuser wall 21, the diffuser wall surface 29 and the fixed diffuser wall 21 are in close contact with each other, and the diffuser 20 is closed. When the diffuser wall surface 29 is in close contact with the fixed diffuser wall 21, the second scroll 32 is formed by the curved wall 31 and scroll wall forming surface 30, and the second passage is formed from the impeller 14 to the second scroll 32. An outlet of the second scroll 32 is in communication with the first scroll 22.

Figure 4:
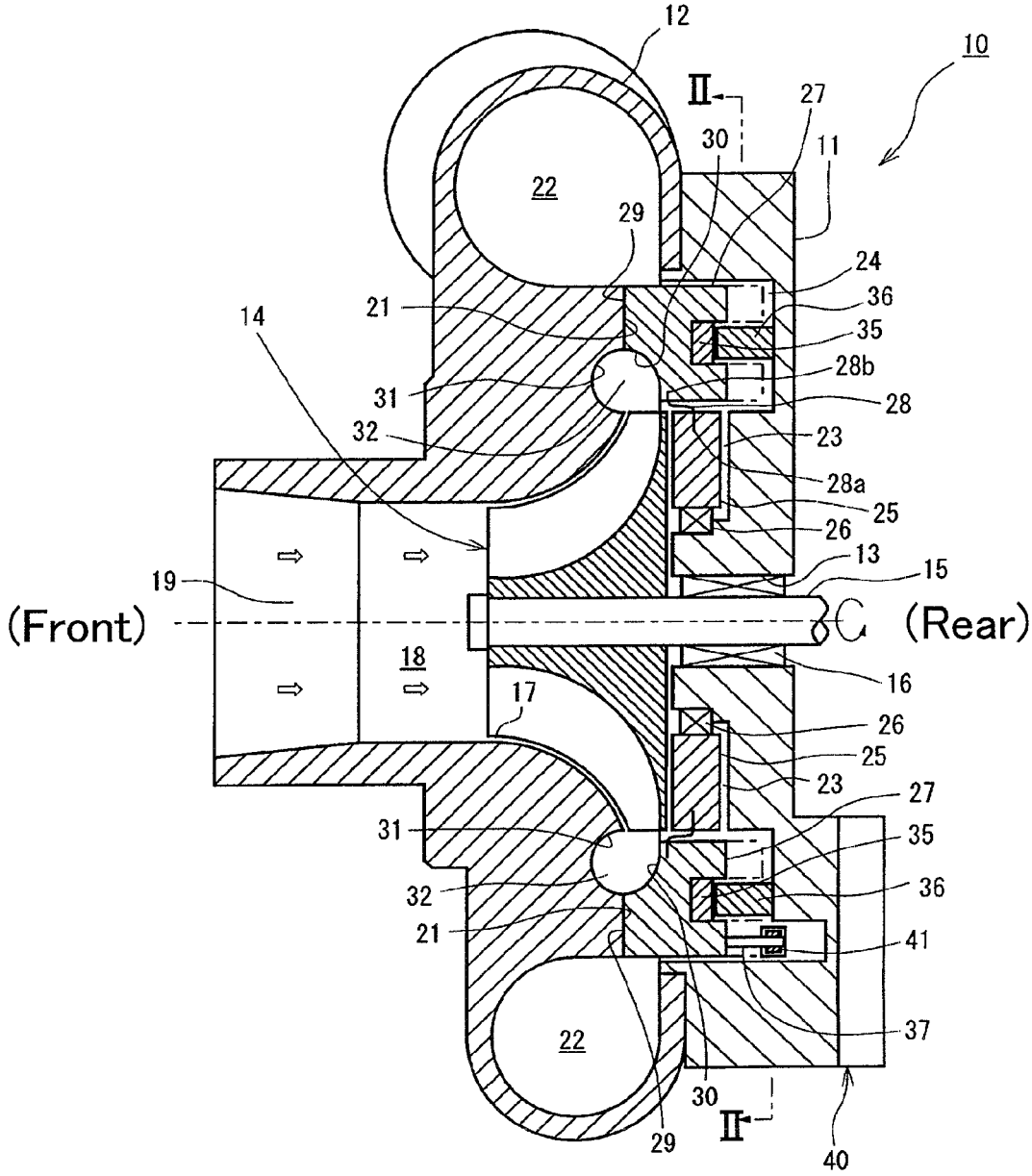
FIG. 4 is a side cross-sectional view of the centrifugal compressor when a second passage is formed.
Figure 5:
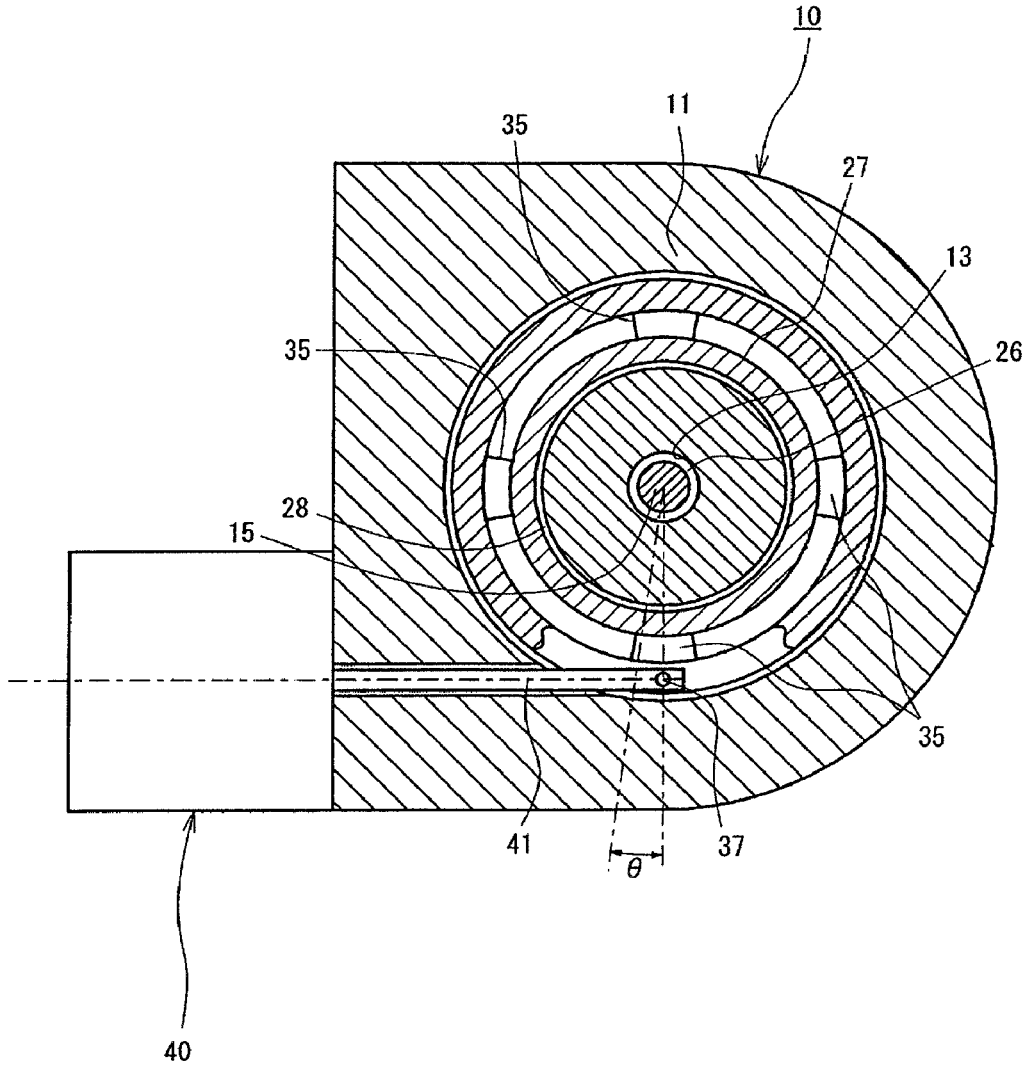
FIG. 5 is a cross-sectional view that is taken along the line II-II in FIG. 4.
Figure 6:
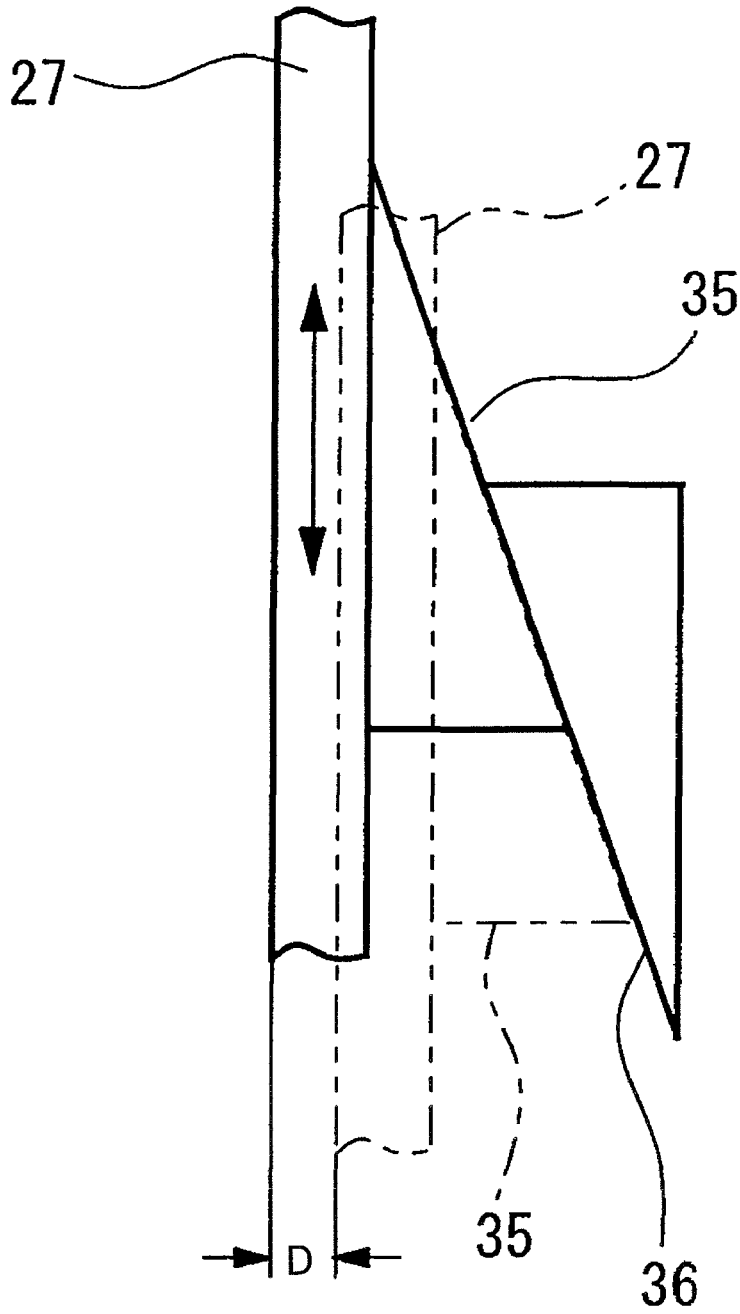
FIG. 6 is a schematic view illustrating an operation of a movable cam and a fixed cam in the centrifugal compressor.

The operation of the centrifugal compressor 10 according to the first embodiment of the present invention will be described. When the centrifugal compressor 10 is stopped, the actuator 40 is not actuated, or in a non-operational state. When the actuator is in the non-operational state, the rod 41 is maintained at a position as shown in FIG. 5. The movable cam 35 is at a position shown by solid lines, and the movable diffuser wall 27 is at a position shown by solid lines as shown in FIG. 6. In this state, the diffuser wall surface 29 is in close contact with the fixed diffuser wall 21, and the second passage is formed as shown in FIG. 4.

When the flow rate of the centrifugal compressor 10 is equal or lower than a predetermined level during the operation of the centrifugal compressor 10, the actuator 40 is not actuated, and the second passage is maintained. The flow rate which does not exceed a predetermined level includes a flow rate at which diffuser stall in the diffuser 20 is inevitable if the gas flows through the diffuser 20 of the first passage. The gas drawn into the impeller 14 during the operation of the centrifugal compressor 10 flows through the second passage which is formed from the impeller 14 to the second scroll 32. At this time, the diffuser 20 is closed, and the gas is not drawn to the first scroll 22. The gas from the impeller 14 is guided by the scroll wall forming surface 30 and the curved wall 31 while flowing swirlingly, and is discharged out from the outlet port through the second scroll 32 and the first scroll 22. In this case, the gas from the impeller 14 does not flow through the diffuser 20, and stall in the diffuser 20 does not occur.

The operation when the flow rate of the centrifugal compressor 10 exceeds a predetermined level is now described. The flow rate which exceeds a predetermined level includes a flow rate at which diffuser stall in the diffuser 20 does not occur when gas flows through the diffuser 20 in the first passage. When the flow rate in the centrifugal compressor 10 exceeds a predetermined level, the actuator 40 is actuated and the rod 41 is moved. In accordance with the movement of the rod 41, the connecting pin 37 is drawn in the circumferential direction (left side in FIG. 2), and the movable diffuser wall 27 is rotated in the clockwise direction by angle θ, as shown in FIG. 2. In accordance with the rotation of the movable diffuser wall 27, as shown in FIG. 6, the movable cam 35 is moved along the inclined surface of the fixed cam 36 from the position indicated by the solid line to a position indicated by an imaginary line (two-dot chain line), and the movable diffuser wall 27 is moved from the position indicated by the solid line to a position indicated by an imaginary line, by distance D. Thus, the movable diffuser wall 27 is moved away from the fixed diffuser wall 21 by the displacement of the flexible member 28, and is moved parallelly in the direction to the outer space 24 to be caved in.

The movable diffuser wall 27 is moved away from the fixed diffuser wall 21, and the diffuser 20 is opened as shown in FIG. 1. By opening the diffuser 20, the first passage is formed from the impeller 14 to the first scroll 22 through the diffuser 20, and the gas from the impeller 14 is drawn into the first scroll 22 through the diffuser 20. At the time, the flow rate of the centrifugal compressor 10 exceeds a predetermined level, therefore, stall in the diffuser 20 does not occur, and the centrifugal compressor 10 is operated stably.

In the first embodiment, the movable diffuser wall 27 opens and closes the diffuser 20 by switching the flow path downstream of the impeller 14 between the passages. That is, the movable diffuser wall 27 switches the flow path downstream of the impeller 14 between a first operational state where the gas from the impeller 14 is drawn to the first scroll 22 through the diffuser 20, and a second operational state where the gas from the impeller 14 is drawn to the second scroll 32 without flowing through the diffuser 20. Concretely, at the flow rate at which stall in the diffuser 20 may occur (generally extremely low flow rate), the movable diffuser wall 27 is brought into contact with the fixed diffuser wall 21. Therefore the diffuser 20 is closed, and the second passage is utilized so that the gas does not flow through the diffuser 20. On the contrary, at the flow rate at which stall in the diffuser 20 may not occur, the movable diffuser wall 27 is moved away from the fixed diffuser wall 21 to open the diffuser 20, thereby the first passage is utilized so that the gas flows through the diffuser 20. Therefore, even when the flow rate is extremely low, stall in the diffuser 20 is prevented, and the centrifugal compressor 10 is operated stably. When the flow rate is sufficient, the diffuser effect is fully obtained, and effective compression is performed.

According to the first embodiment, the following advantageous effects are obtained.

(1) The movable diffuser wall 27 switches the flow path downstream of the impeller 14 between the first passage and the second passage. That is, the movable diffuser wall 27 switches the flow path between the first operational state where the gas from the impeller 14 is drawn to the first scroll 22 through the diffuser 20, and the second operational state where the gas from the impeller 14 is drawn to the second scroll 32 without flowing through the diffuser 20. Therefore, in the state where the gas flows from the downstream of the impeller 14 to the second scroll 32, the gas does not flow through the diffuser 20, and stall in the diffuser 20 does not occur even when the flow rate of the centrifugal compressor 10 is extremely low. On the other hand, when the flow rate is sufficient, the gas is drawn to the first scroll 22 through the diffuser 20. As a result, the centrifugal compressor 10 is stably operated in a wide range of the flow rate.

(2) The movable diffuser wall 27 is moved closer to and away from the fixed diffuser wall 21 to change the cross-sectional area of the diffuser 20 in accordance with the flow rate. Therefore, when the gas flows through the diffuser 20, diffuser effect is obtained sufficiently, and effective compression is achieved.

(3) When the movable diffuser wall 27 closes the diffuser 20, the curved wall 31 and the scroll wall forming surface 30 form part of the second scroll 32. Therefore, the scroll wall forming surface 30 in the movable diffuser wall 27 can introduce the gas from the impeller 14 to the second scroll 32 smoothly.

Figure 7:
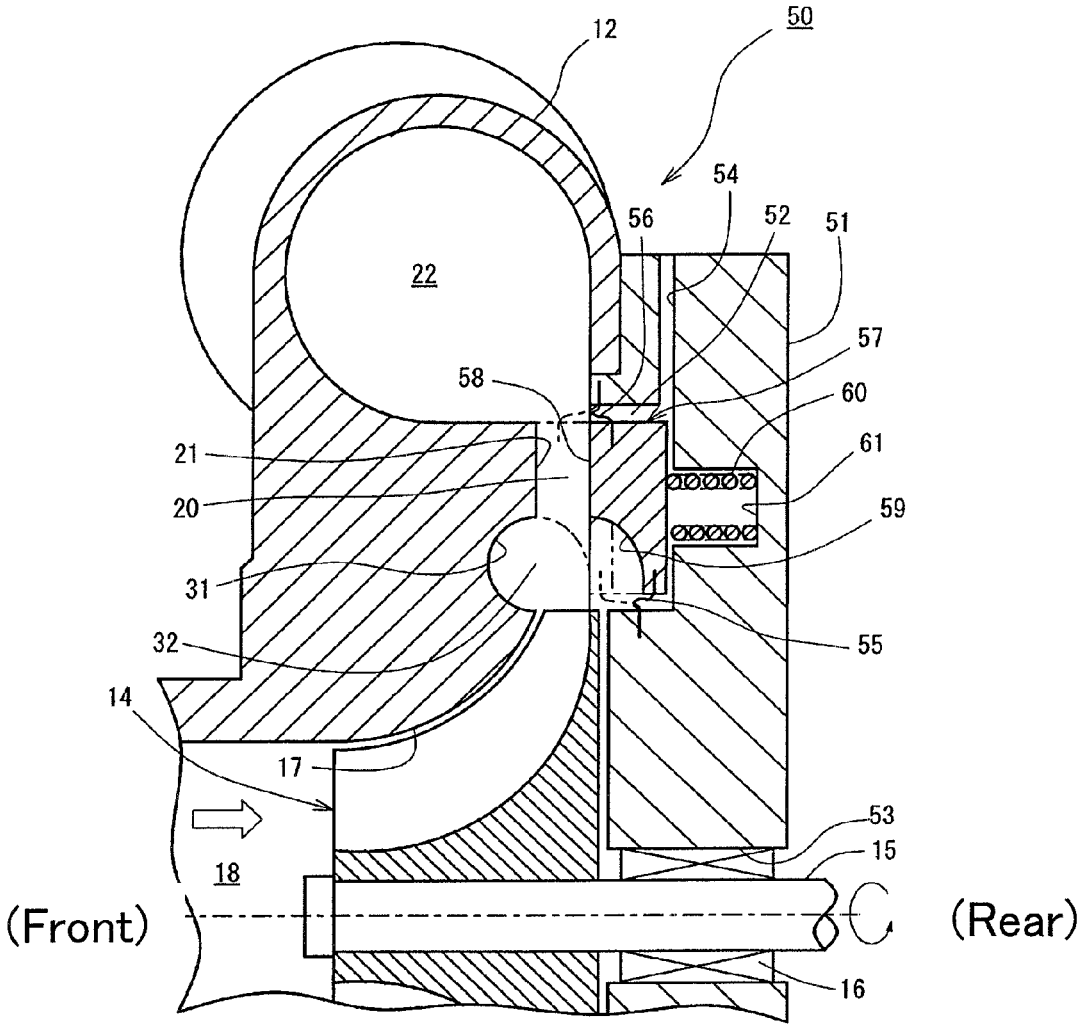
FIG. 7 is a side cross-sectional view of a centrifugal compressor according to a second preferred embodiment of the present invention.

The following will describe a centrifugal compressor according to a second preferred embodiment of the present invention with reference to FIG. 7. Some parts or elements are in common with that of the first embodiment. For the sake of convenience of explanation, like or same parts or elements will be referred to by the same reference numerals as those which have been used in the first embodiment, and the description thereof is omitted.

Referring to FIG. 7, a centrifugal compressor 50 includes the second casing 12, the impeller 14, and the rotary shaft 15, which are substantially the same as that of the first embodiment. A first casing 51 has an annular accommodation space 52 and a shaft hole 53. A movable diffuser wall 57 is disposed in the accommodation space 52. The rotary shaft 15 extends through the shaft hole 53. The accommodation space 52 is in communication with a communication passage 54 which is connected to the outside of the centrifugal compressor 50. The front surface of the movable diffuser wall 57 includes a movable diffuser wall surface 58 and a scroll wall forming surface 59, which are similar to the first embodiment. The scroll wall forming surface 59 in the movable diffuser wall 57 constitutes a part of the wall surface of the second scroll 32, and also constitutes a pressure receiving surface for receiving the internal pressure downstream of the impeller 14.

The inner periphery of the movable diffuser wall 57 and the first casing 51 is connected through a first flexible member 55 in the form of a diaphragm. The outer periphery of the movable diffuser wall 57 and the first casing 51 is connected through a second flexible member 56 in the form of a diaphragm. The flexible members 55, 56 function as members for allowing the movable diffuser wall 57 to move, and also function as pressure receiving surfaces for receiving the internal pressure downstream of the impeller 14. The diffuser 20 and the accommodation space 52 are separated from each other by the movable diffuser wall 57 and the flexible members 55, 56. The accommodation space 52 is in communication with the outside of the centrifugal compressor 50 through the communication passage 54, therefore, the accommodation space 52 is in an atmospheric pressure.

A coil spring 60 as an urging member is disposed between the rear surface of the movable diffuser wall 57 and the first casing 51. The coil spring 60 applies an urging force to the movable diffuser wall 57 in the direction to close the diffuser 20. The flexible volume of the coil spring 60 is set equal to or above the length of the diffuser 20 in the axial direction. The accommodation space 52 has a hole 61 with a bottom for retaining the coil spring 60. The hole 61 regulates the misalignment of the coil spring 60 in the radial direction. Preferably, a plurality of the holes 61 and the coil springs 60 may be formed in the circumferential direction.

In the centrifugal compressor 50 of the second embodiment, the displacement of the movable diffuser wall 57 is determined in accordance with the internal pressure downstream of the impeller 14, instead of the actuator 40 in the first embodiment. When the flow rate of the gas from the impeller 14 is low, the internal pressure downstream of the impeller 14 is low. In this case, the internal pressure acting on the scroll wall forming surface 59 as the pressure receiving surface applies the load to the movable diffuser wall 57 in the reverse direction of the urging force of the coil spring 60. The load is small and the movable diffuser wall 57 is not moved in the direction to the first casing 11 against the urging force of the coil spring 60. The movable diffuser wall 57 is retained in contact with the fixed diffuser wall 21 by the urging force of the coil spring 60. In this state, the diffuser 20 is closed, and the gas from the impeller 14 flows through the second passage.

When the flow rate of the gas from the impeller 14 increases, the internal pressure downstream of the impeller 14 increases. When the internal pressure acting on the scroll wall forming surface 59 as the pressure receiving surface exceeds a predetermined level, the load acting on the movable diffuser wall 57 overcomes the urging force of the coil spring 60. At that time, the movable diffuser wall 57 is moved to the first casing 51 against the urging force of the coil spring 60. By the movement of the movable diffuser wall 57 to the first casing 51, the diffuser 20 is opened and the first passage is formed. The gas from the impeller 14 is introduced into the first scroll 22 through the diffuser 20.

According to the second embodiment, the same advantageous effects as (1) through (3) of the first embodiment are obtained. In addition, the scroll wall forming surface 59 receives the load based on the internal pressure downstream of the impeller 14, and the movable diffuser wall 57 can be moved away from the fixed diffuser wall 21 by utilizing the internal pressure downstream of the impeller 14. Furthermore, the movable diffuser wall 57 can be moved autonomously by the load based on the internal pressure downstream of the impeller 14 and the urging force of the coil spring 60. Therefore, the centrifugal compressor 50 does not need an independent drive force to move the movable diffuser wall 57 closer to and away from the fixed diffuser wall 21. Thus, the simple structure of the centrifugal compressor 50 is obtained, compared to a centrifugal compressor having an actuator. The scroll wall forming surface 59 in the movable diffuser wall 57 forms part of the wall surface of the second scroll 32, and also functions as the pressure receiving surface, thereby the movable diffuser wall 57 does not need an independent pressure receiving surface.

Figure 8:
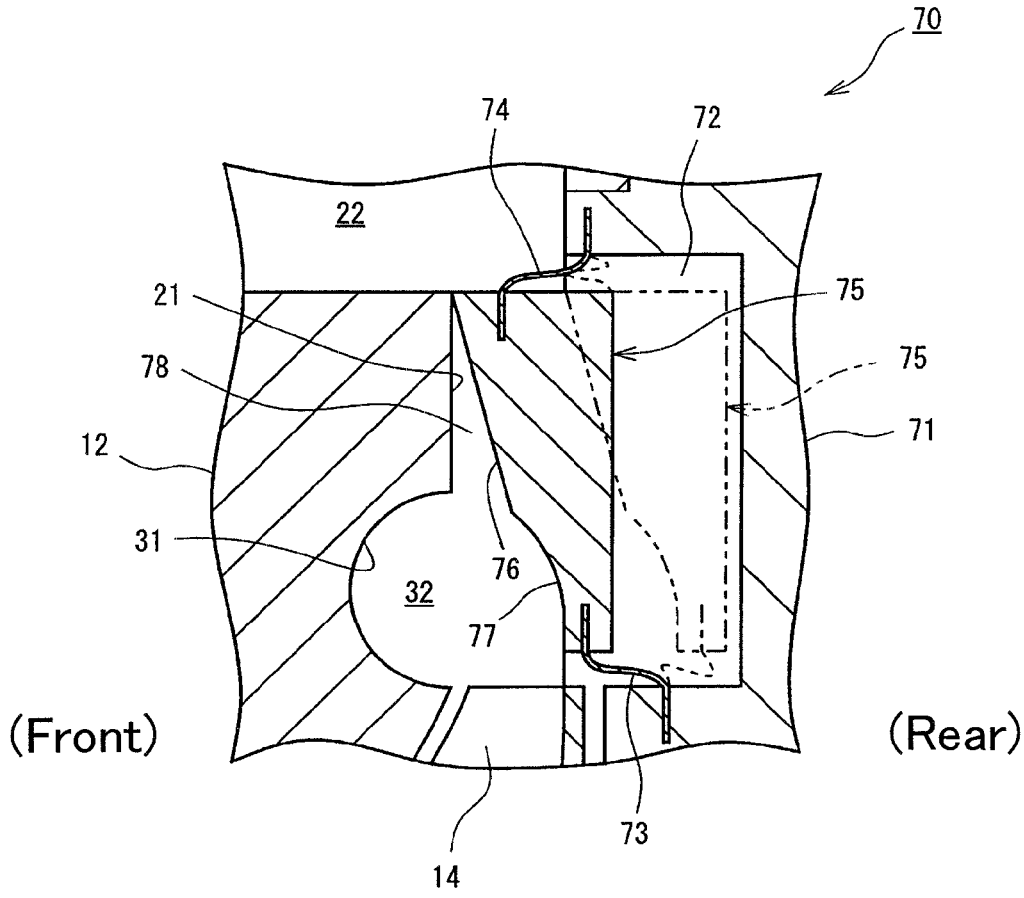
FIG. 8 is a fragmentary cross-sectional view of a centrifugal compressor according to a third preferred embodiment of the present invention.

The following will be describe a centrifugal compressor according to a third preferred embodiment of the present invention with reference to FIG. 8. Since some parts of the centrifugal compressor of the third embodiment are common to those of the centrifugal compressor 10 of the first embodiment, the common or similar reference numerals of the first embodiment are applied to those of the third embodiment to incorporate the common or similar description of the first embodiment into that of the third embodiment.

A centrifugal compressor 70 has a movable diffuser wall 75 which moves autonomously in accordance with the internal pressure downstream of the impeller 14, similar to the second embodiment. Referring to FIG. 8, an accommodation space 72 is defined in the first casing 71 for accommodating the movable diffuser wall 75. The movable diffuser wall 75 is retained at the inner and the outer periphery by flexible members 73, 74, and is movable in the axial direction of a rotary shaft (not shown). In FIG. 8, an urging member is not shown, but an urging member similar to the coil spring 60 of the second embodiment may be utilized. The movable diffuser wall 75 has a diffuser wall surface 76 and a scroll wall forming surface 77 in the side of the second casing 12 (or the wall surface facing the diffuser 78) The diffuser wall surface 76 is formed with a tapered surface which is not parallel to the fixed diffuser wall 21.

The fixed diffuser wall 21 has a wall surface which is parallel to the radial direction of the centrifugal compressor 70. Therefore, when the diffuser wall surface 76 is moved closest to the fixed diffuser wall 21, the edge portion of the movable diffuser wall 75 adjacent to the first scroll 22 is brought into contact with the fixed diffuser wall 21. In this state, a space exists between the diffuser wall surface 76 and the fixed diffuser wall 21, however, the diffuser 78 is closed and the communication is shut off. Thus, the diffuser wall surface 76 of the movable diffuser wall 75 functions as a pressure receiving surface. The diffuser wall surface 76 has the tapered surface so that the cross-sectional area of the pressure receiving surface is increased in the movable diffuser wall 75. The responsiveness of the movement of the movable diffuser wall 75 is improved as the cross-sectional area of the pressure receiving surface in the movable diffuser wall 75 is increased. In the state where the diffuser wall surface 76 is moved closest to the fixed diffuser wall 21, the gas from the impeller 14 is introduced into the second scroll 32 through the second passage.

When the movable diffuser wall 75 is moved to the bottom of the accommodation space 72 in the first casing 51 in accordance with the increase of the internal pressure, the diffuser 78 performs its function, but the cross-sectional area of the passage in the diffuser 78 is decreased as the passage in the diffuser 78 is directed from the impeller 14 toward the first scroll 22.

In the third embodiment, the diffuser wall surface 76 of the movable diffuser wall 75 is formed with the tapered surface. Therefore, the diffuser wall surface 76 functions as the pressure receiving surface and increases the cross-sectional area for receiving the pressure in the movable diffuser wall 75. Compared to a case where a pressure receiving surface includes only the scroll wall forming surface 77, the responsiveness of the movement of the movable diffuser wall 75 responding to the internal pressure can be improved by the increase of the cross-sectional area of the pressure receiving surface.

The present invention is not limited to the embodiments described above but may be modified into alternative embodiments.

In the first and the second embodiments, the diffuser wall surface of the movable diffuser wall is in close contact with the fixed diffuser wall, but in an alternative embodiment, the diffuser wall surface and the fixed diffuser wall may not be in close contact with each other. For example, as shown in FIG. 9A, a minute clearance K may be set between the movable diffuser wall 57 and the fixed diffuser wall 21, and the diffuser 20 does not substantially function due to the pressure loss when the gas flows through the clearance K.

Figure 9A:
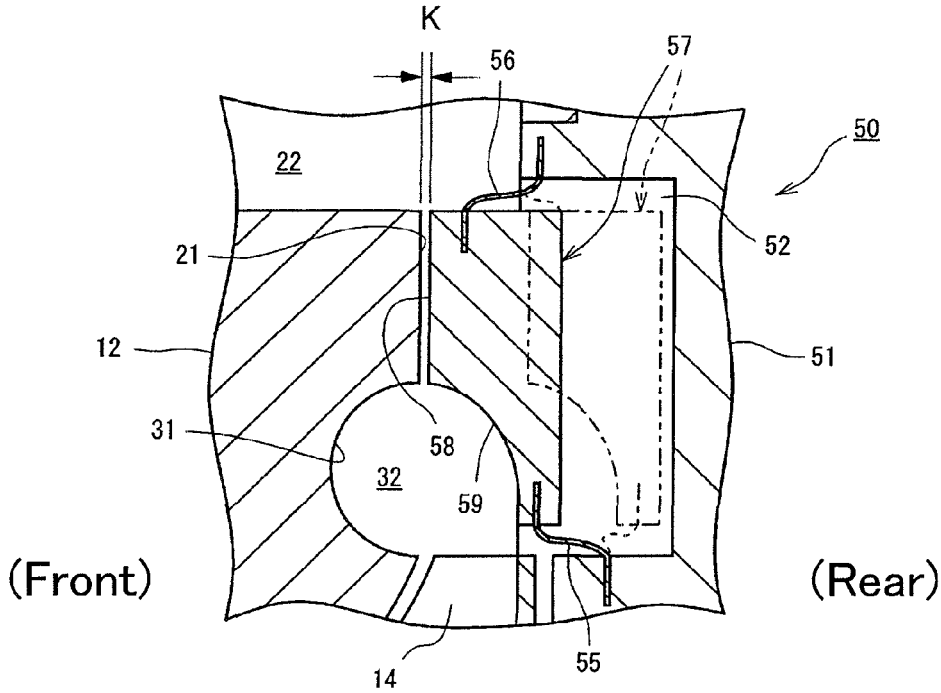
FIG. 9A is an enlarged fragmentary cross-sectional view of a centrifugal compressor having a modified movable diffuser wall according to an alternative embodiment.
Figure 9B:
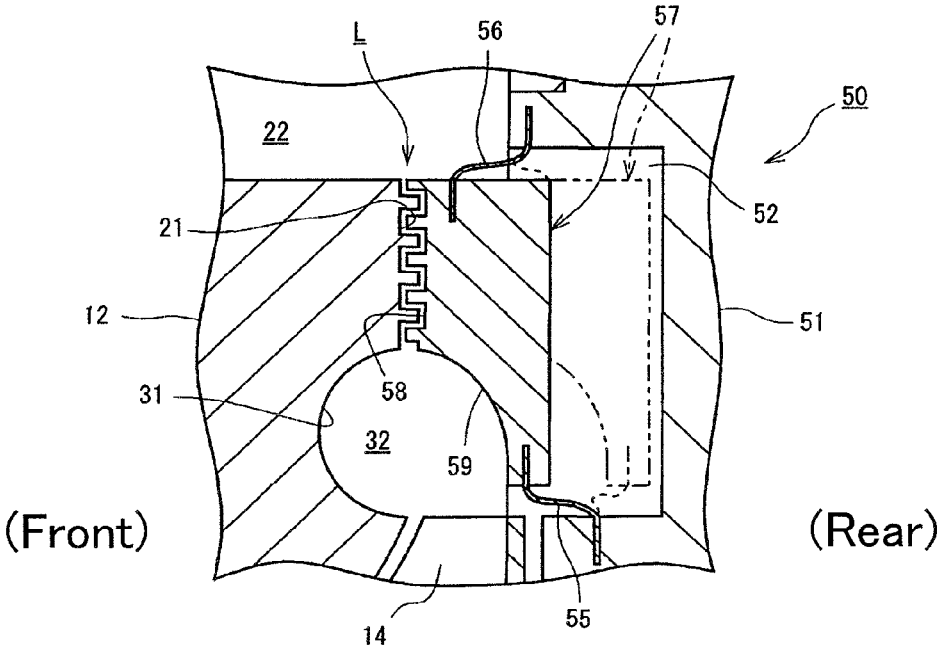
FIG. 9B is an enlarged fragmentary cross-sectional view of a centrifugal compressor having a modified movable diffuser wall according to an alternative embodiment.

As shown in FIG. 9B, the diffuser wall surface 58 of the movable diffuser wall 57 and the fixed diffuser wall 21 are formed with convexes and corresponding concaves. When the diffuser wall surface 58 and the fixed diffuser wall 21 are closer to each other, a minute clearance may be maintained and a labyrinth seal L may be formed.

As shown in FIGS. 9A and 9B, even when the diffuser wall surface 58 of the movable diffuser wall 57 may not be in close contact with the fixed diffuser wall 21, the diffuser 20 does not perform its function and the state is substantially the same as the state where the diffuser 20 is closed. It is noted that the common numerals are used in FIGS. 9A and 9B as the first and the second embodiments for the sake of convenience.

In the first through third embodiments, the movable diffuser walls are formed in the first casings, but a movable diffuser wall as a switching member may be formed in a second casing, or formed in both casings. A movable diffuser wall as a switching member can be formed depending on the construction and the condition of a centrifugal compressor.

In the first through third embodiments, the scroll wall forming surfaces which constitute part of the wall surfaces of the second scrolls are formed in the movable diffuser walls. Another scroll wall forming surface may be formed in a movable diffuser wall adjacent to a first scroll so as to constitute part of the wall surface of the first scroll, depending on a shape of the movable diffuser wall. In this case, the another scroll wall forming surface not only guides the gas to the first scroll, but also functions as a pressure receiving surface for receiving the internal pressure in the first passage. As in the second and the third embodiments, when the movable diffuser wall is moved by the urging member, the responsiveness of the movement of the movable diffuser wall can be further improved.

Therefore, the present examples and embodiments are to be considered as illustrative and not restrictive, and the invention is not to be limited to the details given herein but may be modified within the scope of the appended claims.

What is claimed is:

1. A centrifugal compressor for compressing gas, comprising:

a casing;

a rotary shaft supported by the casing;

an impeller rotatably fixed to the rotary shaft, wherein the impeller sends the gas radially outward to a flow path downstream thereof;

a diffuser formed around the impeller and defined by a pair of diffuser walls having the diffuser therebetween;

a first scroll formed around the diffuser;

a second scroll formed between the diffuser and the impeller;

a first passage formed from the impeller to the first scroll through the diffuser;

a second passage formed from the impeller to the second scroll; and a switching member for switching the flow path between the first passage and the second passage by opening and closing the diffuser, wherein the switching member includes a movable diffuser wall which is at least one of the pair of the diffuser walls, wherein the movable diffuser wall is moved closer to and away from the other of the pair of the diffuser walls so as to switch the flow path between the first passage and the second passage, wherein a wall surface of the movable diffuser wall facing the diffuser includes a diffuser wall surface and a scroll wall forming surface, wherein the scroll wall forming surface forms part of an inner surface of the second scroll.

2. The centrifugal compressor according to claim 1, wherein the diffuser wall surface is formed with a tapered surface so that the cross-sectional area for receiving an internal pressure downstream of the impeller is increased.

3. The centrifugal compressor according to claim 1, wherein the movable diffuser wall is supported by a rotation support plate through a flexible member, wherein the movable diffuser wall is rotatable in the circumferential direction together with the rotation support plate and the flexible member, and is movable in the axial direction of the rotary shaft.

4. The centrifugal compressor according to claim 1, wherein the other of the pair of the diffuser walls is a fixed diffuser wall.

5. The centrifugal compressor according to claim 4, wherein the movable diffuser wall has a movable cam and the fixed diffuser wall has a fixed cam, wherein the movable cam is moved along the fixed cam so that the movable diffuser wall is moved closer to and away from the fixed diffuser wall.

6. The centrifugal compressor according to claim 5, wherein the movable cam includes an inclined portion which has an inclined movable cam surface, and the fixed cam includes an inclined portion which has an inclined fixed cam surface reverse to the inclined movable cam surface, wherein the movable cam and the fixed cam are positioned so that the movable cam surface and the fixed cam surface are continuously in contact with each other.

7. The centrifugal compressor according to claim 4, further comprising an urging member disposed between the movable diffuser wall and the casing, wherein the movable diffuser wall is moved closer to and away from the other of the pair of the diffuser walls by the urging force of the urging member and an internal pressure downstream of the impeller acting on the scroll wall forming surface of the movable diffuser wall.

8. The centrifugal compressor according to claim 1, wherein when the flow rate of the centrifugal compressor exceeds a predetermined level, the switching member switches the flow path so as to form the first passage to open the diffuser, and when the flow rate of the centrifugal compressor is equal or lower than the predetermined level, the switching member switches the flow path so as to form the second passage to close the diffuser.

* * * * *